US005520203A

United States Patent [19]

Segerstrom

[11] Patent Number: 5,520,203

[45] Date of Patent: May 28, 1996

[54] COSMETICS AND THEIR SELECTION, APPLICATION, AND DISTRIBUTION

[76] Inventor: E. Jane Segerstrom, P.O. Box 42006, Houston, Tex. 77242

[21] Appl. No.: 234,425

[22] Filed: Apr. 28, 1994

Related U.S. Application Data

[63] Continuation-in-part of Ser. No. 53,789, Apr. 26, 1993, abandoned.

[51] Int. Cl.[6] ..... A45D 33/28

[52] U.S. Cl. ..... 132/297; 132/293

[58] Field of Search ..... 132/200, 286, 132/316, 317, 314, 315, 296, 297, 293

[56] References Cited

U.S. PATENT DOCUMENTS

| | | | |
|---|---|---|---|
| 3,596,390 | 8/1971 | Scalice | 434/100 |
| 4,421,127 | 12/1983 | Geer | 132/294 |
| 4,526,273 | 8/1985 | Tsuji et al. | 132/286 |
| 5,025,817 | 6/1991 | Wen | 132/296 |
| 5,337,890 | 8/1994 | Lai | 132/296 |

FOREIGN PATENT DOCUMENTS

| | | | |
|---|---|---|---|
| 2224994 | 5/1990 | United Kingdom | 132/294 |

*Primary Examiner*—John G. Weiss

*Attorney, Agent, or Firm*—John R. Casperson; Buskop Law Group

[57] ABSTRACT

A makeup kit is disclosed which contains all of the essentials in one unit. The kit can be customized for users of different hair colors and complexions. A limited number of kit types will accommodate all users. Decision trees are provided to assist users in selecting the optimal kit type. Selection of the optimal kit is facilitated by the provision of color or gray swatches in conjunction with a decision tree to categorize skin shade. A technique for categorizing potential users for other makeup kit systems is also disclosed.

17 Claims, 3 Drawing Sheets

COSMETICS AND THEIR SELECTION, APPLICATION, AND DISTRIBUTION

BACKGROUND OF THE INVENTION

This application is a continuation in part of application Ser. No. 08/053,789 filed Apr. 26, 1993, now abandoned.

In one aspect, this invention relates to cosmetics. In another aspect, it relates to cosmetics kits. In yet another aspect, this invention relates to cosmetics selection.

Cosmetics users are plagued by excessive choices. Since the 1970's, excessive choices have caused retailers to set aside huge spaces, maintain large inventories, and hire and train large staffs to be competitive. A cosmetics system which does not require such large outlays and expenditures would be very desirable.

The number of choices has also required a high level of competence for cosmetics advisors, both in product/color selection and in application techniques. Retaining motivated staff has become increasingly difficult. A cosmetics system which preselects products and colors for the consumer and directs their effective application and use would be further desirable.

The number of choices has also increased the amount of time required to wisely purchase cosmetics. This has occurred at a time when a larger number of women are entering the work force. This leaves many women with less time to spend making their cosmetics selections. Faced with too little time and too many choices, many women leave without buying or don't stop at all. A one-stop system which supplies all the makeup a woman needs for daytime or work with a single call to a catalog house or trip to a retail store would be very desirable.

Cosmetics have traditionally addressed sexy or high-fashion looks. Yet these looks are often inappropriate in the work place. Women have poured into the work place over the past 20 years. Their future depends on their appearance, yet the makeup counters have offered few solutions. A makeup system which offers a professional, quality look for business or social life would satisfy a long felt need.

Cosmetics have traditionally addressed young, Caucasian needs so those with darker complexions or older skins have had difficulty finding suitable products. Although women are living longer and the cosmetics customer base is becoming increasingly multi-ethnic, cosmetic assortments in any given store still don't meet all needs. A system which satisfies multi-ethnic needs over a broad age group is clearly what is needed.

Packaging is a major area of consumer waste. Cosmetic packaging is no exception. Current systems package and sell each product separately, so a set of all the products one needs to look great could include the waste from ten or more packages. A system which groups all the necessaries in one package would clearly cut down on packaging waste.

OBJECTS OF THE INVENTION

It is an object of this invention to save the consumer time and money by offering their basic cosmetics in a single package and retaining the color combination in the package indefinitely.

It is another object of this invention to save the consumer time and space by providing the necessary products and applicators which can be fitted in one small case . . . perfect for travel case, desk drawer or dressing table. Gathering a quantity of full-sized containers into a cosmetic bag or tackle box was a woman's only previous option.

It is a further object of this invention to size and proportion product quantities to run out together so they can be replaced at once. In the past, individual products tended to run out at different times, so the consumer was always having to stop to buy something. This inconvenience is avoided in the invention.

SUMMARY OF THE INVENTION

In accordance with one embodiment of the invention, a makeup kit is provided which contains the necessary assortment of cosmetics for daily use. The makeup kit comprises a tray which contains a foundation, lipstick, mascara, three shadows, brow powder, blusher, pressed powder, and a cream concealer. In a preferred embodiment, the cosmetics are removably mounted as a unit in a carrying case so that they can be readily located. In a further preferred embodiment, the cosmetics are relatively sized so that they will be consumed at about the same time, preferably in about 90 days. This permits the cosmetics unit to be small in size for carrying convenience and also makes replenishment of the unit contents very easy. Replacement can be further facilitated by utilizing a replacement tray which snaps into a half of a minimally sized carrying case. The use of the carrying case is a great improvement over makeup bags or tackle boxes which many women use. A mirror can be provided in the lid of the carrying case for further convenience, and an assortment of brushes and a pencil can be positioned in one or more additional tray compartments if desired.

In another embodiment of the invention there is provided a process for recommending a makeup combination to a prospective user. In order to make the recommendation, data must be gathered to categorize the prospective user into one of a limited number of classes based primarily on hair and skin color. Generally speaking, the process requires the following steps: (a) determining whether the prospective user is or was dark haired (+) or otherwise (–); (b) determining whether the positives item step (a) have golden, cream or sallow colored skin (+) or other skin color (–); (c) determining the skin shades of the positives from step (b) and making a recommendation of a makeup combination based on such determination; (d) determining the skin shades of the negatives from step (b) and making a recommendation of a makeup combination based on such determination; (e) determining whether the negatives from step (a) have unusually weathered or tanned skin (+) or otherwise (–) and making a recommendation of a makeup combination to the positives; (f) determining the skin shade of the negatives from step (e) and making a recommendation of a makeup combination based on such determination. In a preferred embodiment of the invention, potential users are divided into 11 classes based on 8 sample skin shades and 11 different types of makeup kits provide optimal results for all members of all classes.

In another embodiment of the invention, the recommendation is made based on a gray scale. First, it is determined whether the prospective users have golden, cream or yellow colored skin (+) or peach, pink or rosy brown skin (–). Then, it is determined whether the positives from step (a) have brown eyes and have or did have natural mid-brown to black colored hair (+) or otherwise (–). The skin shades of the positives from step (b) against a gray scale and a recommendation of a makeup combination is made based on such determination. The skin shades of the negatives from step (b) are then determined against a gray scale and a recommendation made of makeup combination based on such determination. It is then determined whether the negatives from step (a) have brown eyes and have or did have natural mid-brown to black colored hair (+) or otherwise (–). The skin shades of the positives from step (e) are then determined against a gray scale and a recommendation of a makeup combination made based on such determination. The skin shades of the negatives from step (e) are then determined against a gray scale and a recommendation of makeup combination made based on such determination. The use of the gray scale eliminate much of the subjectivity inherent in true color matching and is easier to use without training.

In accordance with another embodiment of the present invention, there is provided a makeup kit system which is formed by (i) an inventory of customized makeup kit types each characterized by a different combination of makeup colors, and (ii) a means for determining the optimal makeup kit type to be selected from the inventory for a prospective user. This embodiment of the invention can be practiced, for example, by mail order catalog by utilizing a combination decision tree/order form, or by a suitable display in a department store which includes a poster or electronic display to assist the prospective user in selecting the optimal makeup kit for their hair and skin type. In a preferred embodiment, the skin shade determination is made by comparing the skin shade of the prospective user with sample skin shades in the form of swatches of color.

In yet another embodiment of the invention, there is provided a method for assembling an inventory of tailored makeup kits. The potential users of the tailored makeup kits are first categorized into a manageable number of classes. The classes are based primarily on hair color and skin color rather than on the whims of fashion or clothing. A makeup kit is tailored for the classes selected. Specific tailored makeup kits arc packaged for the selected classes. The different types of kits are packaged with identifiers specific for the respective classes for which they have been optimized. The tailored makeup kits are advertised with informational materials to assist the potential users in determining their class and to select the correct kit based on the identifier.

DETAILED DESCRIPTION OF THE INVENTION

Figure 1:
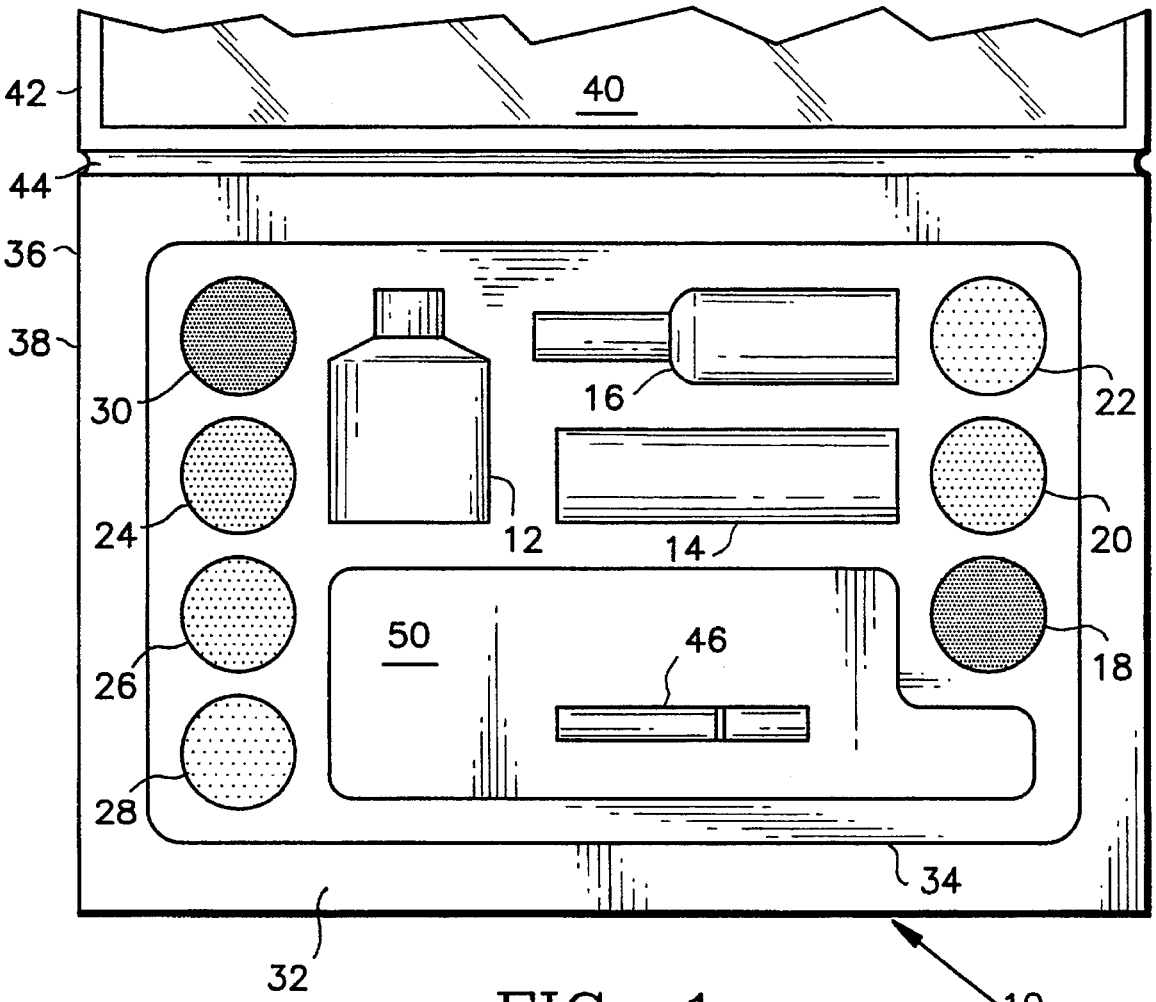
FIG. 1 is a schematic representation of one embodiment of a makeup kit which embodies certain features of the present invention.

In accordance with one embodiment of the invention, a makeup kit 10 is provided which contains the necessary assortment of cosmetics for daily use. The makeup kit contains a foundation 12, lipstick 14, mascara 16, three shadows 18, 20 and 22, brow powder 24, blusher 26, pressed powder 28, and a cream concealer 30 mounted on a tray 34. The tray 34 is located in a frame 32. In a preferred embodiment the cosmetics are relatively sized so that they will be consumed at about the same time, preferably in about 90 days. This permits the kit to be small in size for carrying convenience and also makes replenishment of the cosmetics very easy. Preferably, the tray 34 slips or snaps into a lower half 36 of minimally sized carrying case 38. The lower half 36 of the carrying case 38 is connected to a lid 42 by a hinge 44. A mirror 40 can be provided in the lid 42 of the carrying case 38. The mirror 40 can be a magnifying mirror if desired. An assortment of applicators 46 such as brushes and pencils can be positioned in at least one additional tray compartment 50 if desired.

In a preferred embodiment, the unit additionally contains a shipping container, an instruction booklet, a list of product ingredients, retractable powder and lipstick brushes, a felt shadow applicator, brow/eyeliner/shadow brushes and pencils. Refills for the kit are preferably in the form of a single unit, a tray, containing the items listed in the preceding paragraph.

The contents of the makeup kits vary in color from item to item in the same kit as well as, generally, between the same items in different types of kits. There is uniformity, however, when comparing the same items between different kits of the same type, or replacement trays for kits of the same type. The following Tables IA, IB, IC and ID show optimal cosmetic colors for 13 different cosmetic kits based on the teachings of this invention. In the following Tables, the colors are indicated by the Munsell System as set forth in ASTM D 1535-68. The kits can be selected based on FIGS. 2 and 9.

COSMETICS COLORS FOR EXEMPLARY KIT NUMBERS

TABLE IA

| | KIT NUMBERS | | |
|---|---|---|---|
| | 1 or A-1 | 2 or A-2 | 3 or A-3 |
| FOUNDATION | 5YR 7/4 | 2.5YR 6.6 | 2.5YR 6.6 |
| LIPSTICK | 2.5R 6/8 | 2.5R 5/8 | 7.5R 4/10 |
| MASCARA | 2.5PB 2/4 | 2.5PB 2/4 | 2.5PB 2/4 |
| SHADOW 1 | N 9.51 | 10YR 9/2 | 10YR 9/2 |
| SHADOW 2 | 5YR 6/4 | 5YR 6/4 | 7.5R 6/6 |
| SHADOW 3 | 5PB 3/2 | 7.5BG | 7.5B6 4/2 |
| BROWS | 5YR 5/4 | 5YR 5/4 | 5YR 5/4 |
| BLUSHER | 5R 7/6 | 5R 7/6 | 2.5R 6/6 |
| POWDER | 7.5YR 9/2 | 7.5YR 9/2 | 7.5YR 9/2 |
| CONCEALER | 2.5YR 7/4 | 2.5YR 7/4 | 2.5YR 7/4 |
| PENCIL | 10R 3/2 | 10R 3/2 | 10R 3/2 |

TABLE IB

| | KIT NUMBERS | | | | |
|---|---|---|---|---|---|
| | 4 or B-1 | 5 or B-2 | 6 or B-3 | 7 or B-4 | 8 or B-5 |
| FOUNDATION | 5YR 7/4 | 5YR 7/6 | 5Y4 6/6 | 2.5YR 4/6 | 5YR 3/4 |
| LIPSTICK | 5R 4/10 | 5R 5/14 | 7.5R 4/10 | 7.5R 4/10 | 5R 4/14 |
| MASCARA | 2.5PB 2/4 | N 1.5/ | N 1.5/ | N 1.5/ | N 1.5/ |
| SHADOW 1 | 10YR 9/2 | 10YR 9/2 | 7.5YR 8/4 | 7.5YR 8/4 | 7.5Yr 7/6 |
| SHADOW 2 | 7.5R 7/6 | 7.5R 7/6 | 10R 6/6 | 7.5R 4/8 | 7.5R 4/8 |
| SHADOW 3 | 7.5BG 4/2 | 10PB 4/4 | 5B 5/8 | 5B 5/8 | 5B 5/8 |
| BROWS | 7.5YR 2/2 | 7.5YR 2/2 | 7.5YR 2/2 | 7.5YR 2/2 | 7.5YR 2/8 |
| BLUSHER | 5R 6/6 | 5R 6/6 | 5R 6/8 | 5R 6/8 | 2.5R 4/12 |
| POWDER | 7.5YR 9/2 | 7.5YR 8/4 | 5YR 7/4 | 5YR 7/4 | 5YR 7/4 |
| CONCEALER | 5YR 7/4 | 7.5YR 7/6 | 5YR 6/6 | 5YR 4/4 | 5YR 4/4 |
| PENCIL | 10R 3/2 | 7.5YR 2/2 | 7.5YR 2/2 | 7.5YR 2/2 | 7.5YR 2/2 |

TABLE IC

| | KIT NUMBERS | | |
|---|---|---|---|
| | 11 or C-1 | 12 or C-2 | 13 or C-3 |
| FOUNDATION | 7.5YR 7/4 | 7.5YR 7/4 | 5YR 6/6 |
| LIPSTICK | 7.5R 4/12 | 7.5R 4/12 | 7.5R 4/12 |
| MASCARA | N 1.5/ | 2.5PB 2/4 | 2.5PB 2/4 |
| SHADOW 1 | 10YR 9/2 | 7.5YR 8/4 | 7.5YR 8/4 |
| SHADOW 2 | 10YR 6/8 | 7.5R 6/6 | 10R 6/6 |
| SHADOW 3 | 5PB 4/4 | 7.56 4/2 | 10BG 5/4 |
| BROWS | 7.5YR 2/2 | 7.5YR 2/2 | 7.5YR 2/2 |
| BLUSHER | 7.5R 6/6 | 5R 6/6 | 2/5R 5/6 |
| POWDER | 7.5YR 8/4 | 7.5YR 8/4 | 7.5YR 8/4 |
| CONCEALER | 2.5YR 7/4 | 7.5YR 6/6 | 5YR 5/6 |
| PENCIL | 7.5YR 2/2 | 7.5YR 2/2 | 7.5YR 2/2 |

TABLE ID

| | KIT NUMBERS | |
|---|---|---|
| | 9 | 10 |
| FOUNDATION | 10YR 7/4 | 5YR 6/4 |
| LIPSTICK | 5R 4/10 | 5R 4/10 |
| MASCARA | 2.5PB 2/4 | 2.5PB 2/4 |
| SHADOW 1 | N 9.5/ | 7.5YR 9/2 |
| SHADOW 2 | 5YR 6/4 | 5YR 6/4 |
| SHADOW 3 | 5PB 2/4 | 7.5BG |
| BROWS | 10R 3/2 | 10R 3/2 |
| BLUSHER | 2.5R 7/8 | 5R 5/8 |
| POWDER | N1/ | 10R 9/2 |
| CONCEALER | 2.5YR 7/4 | 2.5YR 7/4 |
| PENCIL | 10R 3/2 | 10R 3/2 |

Figure 2:
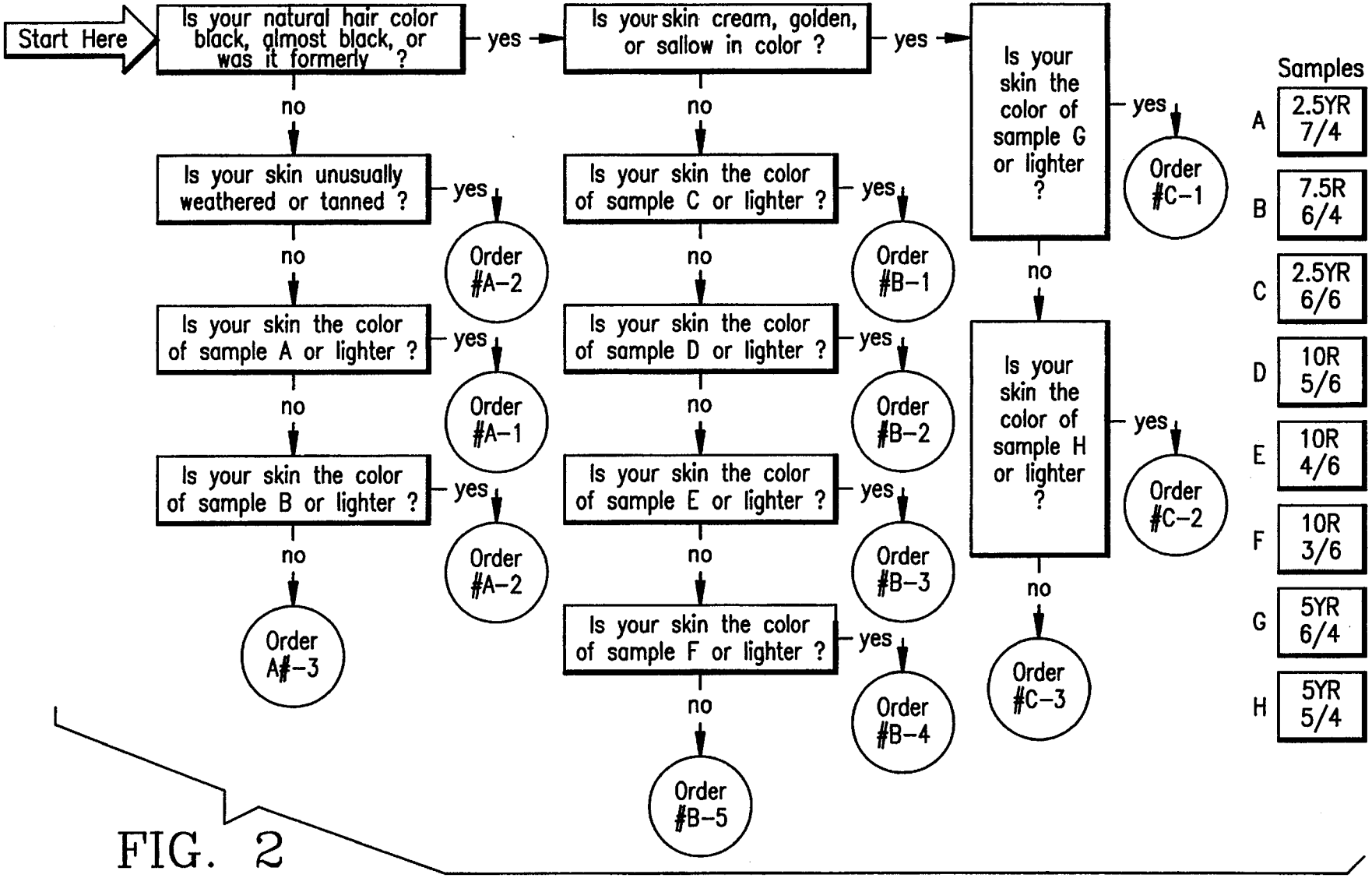
FIG. 2 is flow chart of a decision tree which can be used to reach decisions in accordance with certain features of one embodiment of the invention.

In another embodiment of the invention there is provided a process for recommending a specific makeup combination such as one of the above kits to a prospective user. In order to make the determination, data must be gathered to categorize the prospective user into one of a limited number of classes (such as in the range of 7 to 15 classes) based primarily on hair and skin color. Generally speaking, the process requires the following steps: (a) determining whether the prospective user is or was dark haired (+) or otherwise (–); (b) determining whether the positives from step (a) have golden cream or sallow colored skin (+) or other skin color (–); (c) determining the skin shades of the positives from step (b) and making a recommendation of a makeup combination based on such determination; (d) determining the skin shades of the negatives from step (b) and making a recommendation of makeup combination based on such determination; (e) determining whether the negatives from step (a) have unusually weathered or tanned skin (+) or otherwise (–) and making a recommendation of a makeup combination to the positives; (f) determining the skin shades of the negatives from step (e) and making a recommendation of a makeup combination based on such determination. A preferred embodiment of this process is illustrated by FIG. 2 which shows a decision tree with a limited number of outcomes (generally in the range of 7 to 15) which correlate with the kits labeled by kit number in the top row of the above Tables. The samples in the right hand column can be color swatches or plates having the indicated coloration based on the Munsell systems as described above. Using the plates, the negatives from step (e) are characterized in one of three coloration categories and paired with an optimal class "A" kit from Table IA; the negatives from step (b) are characterized in one of five coloration categories and paired with an optimal class "B" kit from Table IB; and the positives from step (b) are characterized in one of three coloration categories and paired with an optimal class "C" kit from Table IC. As can be ascertained from inspection of the Tables, the color combination is different for each kit. Skin color is preferably determined along the jaw line of a clean face in natural indirect light.

In accordance with another embodiment of the present invention, there is provided a makeup kit system which is formed by (i) an inventory of customized makeup kit types, each characterized by a different combination of makeup colors, and (ii) a means for determining the optimal makeup kit type from the inventory for a prospective user. The individual makeup kits can be as described above. The number of different types of kits can vary, but will often be between 7 and 15, for example. The inventory of different types of kits can be formed on a display counter supporting stacks of the various kits identified in the hereinabove Tables, for example. The means for determining the optimal makeup type can be a decision tree as shown in FIG. 2, or the same inquiries could be posed by questionnaire or by interactive computer program, for example. Coloration can be determined by comparison to sample swatches as previously described.

In yet another embodiment of the invention, there is provided a method for providing users with a tailored makeup kit. The first step is to categorize the potential users of the tailored makeup kits into a manageable number of classes. This can be done as previously described, using colored samples. Makeup kits are tailored for the desired classes. This can be conducted by a skilled cosmetics person based on the trends shown in the Tables as they vary with coloration. Specific tailored makeup kits which have been optimized for a particular class are packaged and are identified with identifiers specific for the respective classes for which they have been optimized. The tailored makeup kits are advertised with informational materials to assist the potential users in determining their class and to select the correct kit based on the identifier. Suitable informational materials can be as previously discussed. By using these techniques, the decision tree and cosmetic units can be modified to meet a nation's, for an area's demographics. They can also be modified to meet specific race or age requirements. They can also be modified to meet specific occupational or physical requirements.

In accordance with another embodiment of the invention, there is provided another process for recommending a specific makeup combination such as one of the above kits to a prospective user. Generally speaking, the process requires the following steps: (a) determining whether the prospective users have golden, cream or yellow colored skin (+) or peach, pink or rosy brown skin (–); (b) determining whether the positives from step (a) have brown eyes and have or did have natural mid-brown to black colored hair (+) or otherwise (–); (c) determining the skin shades of the positives from step (b) against a gray scale and making a recommendation of a makeup combination based on such determination; (d) determining the skin shades of the negatives from step (b) against a gray scale and making a recommendation of makeup combination based on such determination; (e) determining whether the negatives from step (a) have brown eyes and have or did have natural mid-brown to black colored hair (+) or otherwise (–); (f) determining the skin shades of the positives from step (e) against a gray scale and making a recommendation of a makeup combination based on such determination; (g) determining the skin shades of the negatives from step (e) against a gray scale and making a recommendation of makeup combination based on such determination.

Figure 9:
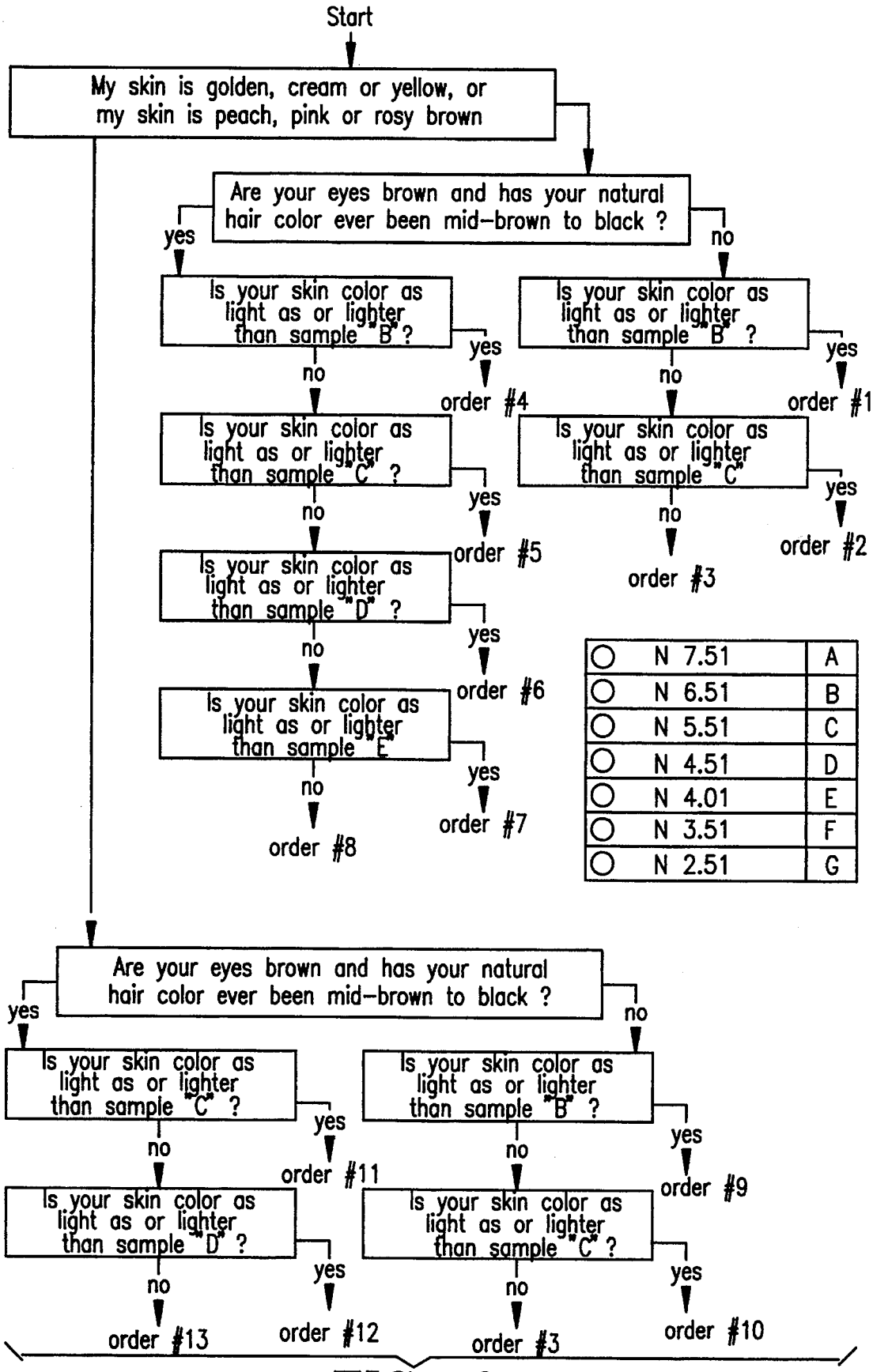
FIG. 9 is flow chart of a decision tree which can be used to reach decisions in accordance with certain features of another embodiment of the invention.

A preferred embodiment of this process is illustrated by FIG. 9 which shows a decision tree with a limited number of outcomes (generally in the range of 7 to 15) which correlate with the kits labeled by kit number in the top row of the above Tables. The samples in the lower right corner of FIG. 9 can be color swatches or plates having the indicated gray scale coloration based on the Munsell system as described above. Preferably, a single gray card having a plurality of gray swatches with one or more apertures therethrough as shown in FIG. 9 is used to determine coloration. The card is preferably used by the prospective user to make the determination of skin shade by holding the card against the side of their neck. The user squints their eyes and selects the shade which appears nearest to their skin's value.

Certain aspects of the invention are further illustrated by the following example, which describes the art of applying the 3 shades of eye shadow found in the kits.

EXAMPLE

Applying Eye Shadow

Aren't eye shadows supposed to match your clothing? Not necessarily. Since a quietly beautiful, daytime/business face is our goal, these shadows were specifically chosen to enhance your eyes—not your wardrobe. Expressive eyes sell you to prospective employers, advance you socially and attract quality love interests.

Three eye shadows were chosen for your makeup kit to allow full contouring potential with a minimum time commitment. Use them every day.

Figure 3:
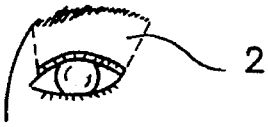
FIGS. 3 through 8 pictorially illustrate the application of cosmetics according to certain teachings in accordance with the Example set forth herein.

Your lightest eye shadow is the primer or undercoat which lightens and highlights the eye area. Apply it smoothly from brow to lash line with your light shadow brush. Confine it to the space indicated at 2 on FIG. 3.

Your middle eye shadow is the magic erasure which removes years and/or reshapes your eye socket. Apply it with your middle shadow brush and blend the edges.

For a mature face—by lightly dusting protruding areas such as the small bulges near inner eye, they'll recede and leave a cleaner, younger line.

Figure 4:
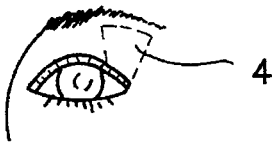

For diagonal brow bone—by sweeping shadow vertically from crease almost to brow in a fan shape, see area 4 in FIG. 4, you'll appear younger.

For Oriental eyes—by deepening the crease and thickening and lifting the outer eye area, eyes appear more open.

Figure 5:
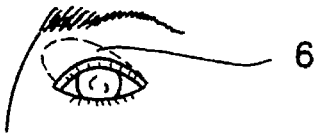

For wide set eyes—by filling in a triangle which is thickest at inner eye between crease and brow and which steadily narrows to nothing at crease of outer eye, you'll appear more beautiful. See area 6 on FIG. 5.

For close set eyes—by reversing the triangle to be thickest at the outer eye and narrowing to nothing at the crease above the mid eye, you'll widen your eyes.

For deep set eyes—warning—don't darken crease or lid except for accent on outermost part of upper lids, or you'll undo the magic of the light shadow.

Your darkest eye shadow plays two roles, as a more dominate shadow and as an eyeliner.

Use it as a shadow to dramatize and/or lift the outer eye. Apply with side and edge of sponge applicator. Blend your shadows with opposite side.

Figure 7:
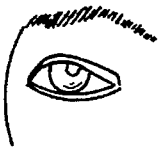
Figure 6:
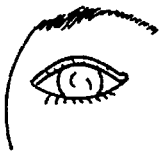
Figure 8:
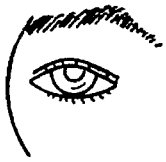

Use it as a liner to define your lashes and/or to recontour your eye shape. Apply dry with eyeliner brush until you've determined line length and thickness. Later, try applying it with a wet brush for deeper tone or stronger emphasis; blend. Evaluate the difference.

a) Average eyes—line just outside your upper and lower lashes from the outside in. Taper your upper liner to stop at the inside of the iris; taper your lower liner to stop at the outside of the iris. See FIG. 6.

b) Floating irises—when you can see white space below or above your iris without moving your head, line the full underlash or upperlash to diminish the effect. See FIG. 7.

c) Hidden irises—when your Oriental or prominent lids hood your eyes, thicken your upper liner directly above your iris to give the illusion of a rounder, fuller eye. Carry the fuller line to the outer edge of the eye. See FIG. 8.

d) Small or close set eyes—can look larger, more wide set, by thickening the liner at the outer corners. Don't extend the liner outside the lashes, however, or your trick will be apparent, and never thicken the lower, outer liner if your lower eye shape is flat or drooping at the outer corners.

While certain preferred embodiments of the invention have been hereinabove described, the invention is not to be construed as so limited, except to the extent that such limitations are found in the claims.

What is claimed is:

1. A makeup kit having a combination of colored makeup items mounted in a tray said makeup kit comprising:

a foundation having a first color;

a lipstick having a second color;

a mascara having a third color;

a first shadow having a fourth color;

a second shadow having a fifth color;

a third shadow having a sixth color;

a brow powder having a seventh color;

a blusher having an eighth color;

a pressed powder having a ninth color, and a cream concealer having a tenth color;

said makeup kit having combination of colors selected from the group consisting of a color combination number A-1, wherein said first color is 5YR 7/4, said second color is 2.5R 6/8, said third color is 2.5PB 2/4, said fourth color is N 9.51, said fifth color is 5YR 6/4, said sixth color is 5PB 3/2, said seventh color is 5YR 5/4, said eighth color is 5R 7/6, said ninth color is 7.5YR 9/2, and said tenth color is 2.5YR 7/4;

a color combination number A-2, wherein said first color is 2.5YR 6.6, said second color is 2.5R 5/8, said third color is 2.5PB 2/4, said fourth color is 10YR 9/2, said fifth color is 5YR 6/4, said sixth color is 7.5BG, said seventh color is 5YR 5/4, said eighth color is 5R 7/6, said ninth color is 7.5YR 9/2, said tenth color is 2.5YR 7/4:

a color combination number A-3, wherein said first color is 2.5Y 6.6, said second color is 7.5R 4/10, said third color is 2.5PB 2/4, said fourth color is 10YR 9/2, said fifth color is 7.5R 6/6, said sixth color is 7.5B6 4/2, said seventh color is 5YR 5/4, said eighth color is 2.5R 6/6, said ninth color is 7.5YR 9/2, said tenth color is 2.5YR 7/4;

a color combination number B-1, wherein said first color is 5YR 7/4, said second color is 5R 4/10, said third color is 2.5PB 2/4, said fourth color is 10YR 9/2, said fifth color is 7.5R 7/6, said sixth color is 7.5BG 4/2, said seventh color is 7.5YR 2/2, said eighth color is 5R 6/6, said ninth color is 7.5YR 9/2, said tenth color is 5YR 7/4;

a color combination number B-2, wherein said first color is 5YR 7/6, said second color is 5R 5/14, said third color is N 1.5/, said fourth color is 10YR 9/2, said fifth color is 7.5R 7/6, said sixth color is 10PB 4/4, said seventh color is 7.5YR 2/2, said eighth color is 5R 6/6, said ninth color is 7.5YR 8/4, said tenth color is 7.5YR 7/6;

a color combination number B-3, wherein said first color is 5Y4 6/6, said second color is 7.5R 4/10, said third color is N 1.5/, said fourth color is 7.5YR 8/4, said fifth color is 10R 6/6, said sixth color is 5B 5/8, said seventh color is 7.5YR 2/2, said eighth color is 5R 6/8, said ninth color is 5 YR 7/4, said tenth color is 5YR 6/6;

a color combination number B-4, wherein said first color is 2.5YR 4/6, said second color is 7.5R 4/10, said third color is N 1.5/, said fourth color is 7.5YR 8/4, said fifth color is 7.5R 4/8, said sixth color is 5B 5/8, said seventh color is 7.5YR 2/2, said eighth color is 5R 6/8, said ninth color is 5YR 7/4, said tenth color is 5YR 4/4;

a color combination number B-5, wherein said first color is 5YR 3/4, said second color is 5R 4/14, said third color is N 1.5/, said fourth color is 7.5YR 7/6, said fifth color is 7.5R 4/8, said sixth color is 5B 5/8, said seventh color is 7.5YR 2/8, said eighth color is 2.5R 4/12, said ninth color is 5YR 7/4, said tenth color is 5YR 4/4;

a color combination number C-1, wherein said first color is 7.5YR 7/4, said second color is 7.5R 4/12, said third color is N 1.5/, said fourth color is 10YR 9/2, said fifth color is 10YR 6/8, said sixth color is 5PB 4/4, said seventh color is 7.5YR 2/2, said eighth color is 7.5R 6/6, said ninth color is 7.5YR 8/4, said tenth color is 2.5YR 7/4;

a color combination number C-2, wherein said first color is 7.5YR 7/4, said second color is 7.5R 4/12, said third color is 2.5PB 2/4, said fourth color is 7.5YR 8/4, said fifth color is 7.5R 6/6, said sixth color is 7.56 4/2, said seventh color is 7.5YR 2/2, said eighth color is 5R 6/6, said ninth color is 7.5YR 8/4, said tenth color is 7.5YR 6/6; and a color combination number C-3, wherein said first color is 5YR 6/6, said second color is 7.5R 4/12, said third color is 2.5PB 2/4, said fourth color is 7.5YR 8/4, said fifth color is 10R 6/6, said sixth color is 10BG 5/4, said seventh color is 7.5YR 2/2, eighth color is 2/5R 5/6, said ninth color is 7.5YR 8/4, said tenth color is 5YR 5/6;

wherein each color is defined by the Munsell System.

2. A makeup kit system comprising an inventory of different makeup kit types, each characterized by a different combination of makeup colors, said inventory containing in the range of 7 to 15 different makeup kit types, and a means for indicating an optimal makeup kit type to be selected from the inventory for a prospective user.

3. A makeup kit system as in claim 2 wherein each makeup kit comprises a tray containing:

a foundation having a first color;

a lipstick having a second color;

a mascara having a third color;

a first shadow having a fourth color;

a second shadow having a fifth color;

a third shadow having a sixth color;

a brow powder having a seventh color;

a blusher having an eighth color;

a pressed powder having a ninth color; and a cream concealer having an tenth color.

4. A makeup kit system as in claim 2, wherein each makeup kit further comprises a carrying case, wherein the tray is removably mounted in the carrying case.

5. A makeup kit system as in claim 4 wherein the carrying case has a base portion and a lid portion hingedly fastened together, and the tray is positioned in the base portion of the case.

6. A makeup kit system as in claim 5, wherein the carrying case further comprises a mirror mounted to the inside of the lid portion of the case.

7. A makeup kit system as in claim 6 wherein the tray has a depression for brushes, and the mirror is a magnifying mirror.

8. A makeup kit system as in claim 2 wherein the means for indicating an optimal makeup kit type comprises (a) means for indicating a first plurality of predetermined makeup kits for a user that is or was dark haired (+) and a second plurality of predetermined makeup kit types for a user that is otherwise (–);

(b) means for indicating a third plurality of predetermined makeup kit types taken from the first plurality to the positives from step (a) have golden, cream or sallow colored skin (+) and a fourth plurality of predetermined makeup kits taken from the first plurality to the positives from step (a) who have other skin color (–);

(c) means for determining the skin shades of the positives from step (b);

(d) means for indicating an optimal makeup kit type taken from the third plurality based on a skin shade determination;

(e) means for determining the skin shades of the negatives from step (b);

(f) means for indicating an optimal makeup kit type taken from the fourth plurality based on a skin shade determination;

(g) means for indicating an optimal makeup kit type taken from the second plurality to the negatives from step (a) that have unusually weathered or tanned skin (+) and a fifth plurality of predetermined makeup kit types taken from the second plurality to a user that is otherwise (–);

(h) means for determining the skin shades of the negatives from step (g); and (i) means for indicating an optimal makeup kit type taken from the fifth plurality based on a skin shade determination.

9. A makeup kit system as in claim 8 wherein the means for determining the skin shades of the positives from step (b) provides skin shade classification in one of three categories.

10. A makeup kit system as in claim 8 wherein the means for determining the skin shades of the negatives from step (b) provides skin shade classification in one of five categories.

11. A makeup kit system as in claim 8 wherein the means for determining the skin shades of the negatives from step (e) provides skin shade classification in one of three categories.

12. A makeup kit system as in claim 8 wherein the means for determining the skin shades comprises colored samples.

13. A makeup kit system as in claim 2 wherein the means for determining the optimal makeup kit type comprises (a) means for indicating a first plurality of predetermined makeup types for a user that has golden, cream or yellow colored skin (+) and a second plurality of predetermined makeup kit types for a user that has peach, pink or rosy brown skin (–);

(b) means for indicating a third plurality of predetermined makeup kit types taken from the first plurality to the positives from step (a) that have brown eyes and have or did have natural mid-brown to black colored hair (+) and a fourth plurality of predetermined makeup kit types taken from the first plurality to users that are otherwise (–);

(c) means for determining the skin shades of the positives from step (b) against a gray scale;

(d) means for indicating an optimal makeup kit type taken from the third plurality based on a skin shade determination;

(e) means for determining the skin shades of the negatives from step (b) against a gray scale;

(f) means for indicating an optimal makeup kit type taken from the fourth plurality based on a skin shade determination;

(g) means for indicating a fifth plurality of predetermined makeup kit types taken from the second plurality to the the negatives from step (a) that have brown eyes and have or did have natural mid-brown to black colored hair (+) and a sixth plurality of predetermined makeup kit types taken from the second plurality to users that are otherwise (–);

(h) means for determining the skin shades of the positives from step (g) against a gray scale;

(i) means for indicating an optimal makeup kit type taken from the fifth plurality based on a skin shade determination;

(j) means for determining the skin shades of the negatives from step (g) against a gray scale; and (k) means for indicating an optimal makeup kit type taken from the sixth plurality based on a skin shade determination.

14. A makeup kit system as in claim 13 wherein the means for determining the skin shades of the positives from step (b) provides skin shade classification in one of three categories.

15. A makeup kit system as in claim 13 wherein the means for determining the skin shades of the negatives from step (b) provides skin shade classification in one of three categories.

16. A makeup kit system as in claim 13 wherein the means for determining the skin shades of the positives from step (g) provides skin shade classification in one of five categories.

17. A makeup kit system as in claim 12 wherein the means for determining the skin shades of the negatives from step (g) provides skin shade classification in one of three categories.

* * * * *